US005203950A

United States Patent [19]

Spoelders

[11] Patent Number: 5,203,950

[45] Date of Patent: Apr. 20, 1993

[54] DEVICE FOR CUTTING ACCORDING TO A SAW TOOTH PATTERN THE EXTREMITIES OF VENEER TAPES BETWEEN TWO PAIRS OF UPPER AND UNDER KNIVES

[76] Inventor: Ludy Spoelders, Hombekerkouter 100, 2930 Mechelen (Hombeek), Belgium

[21] Appl. No.: 841,225

[22] Filed: Feb. 21, 1992

Related U.S. Application Data

[63] Continuation of Ser. No. 425,753, Oct. 23, 1989, abandoned.

[51] Int. Cl.[5] ..... B31F 5/00

[52] U.S. Cl. ..... 156/506; 156/159; 156/502; 156/505; 156/507; 156/510; 83/618; 83/620; 83/622; 83/555

[58] Field of Search ..... 83/618, 620, 622, 555, 83/378, 382, 383, 384; 156/159, 258, 266, 304.5, 502, 505, 506, 507, 510, 583.1

[56] References Cited

U.S. PATENT DOCUMENTS

| | | | |
|---|---|---|---|
| 1,453,200 | 4/1923 | Stacho | 83/383 X |
| 2,213,744 | 9/1940 | Robertson | 156/583.8 X |
| 3,204,504 | 9/1965 | Bradlee | 83/382 X |
| 3,608,413 | 9/1971 | Borello | 83/622 X |
| 3,775,225 | 11/1973 | Schott, Jr. | 156/510 |
| 4,063,483 | 12/1977 | Kawaguchi et al. | 83/382 |
| 4,104,942 | 8/1978 | Leloux | 83/622 X |
| 4,421,591 | 12/1983 | DeLigt | 156/511 X |
| 4,499,805 | 2/1985 | Mori | 83/618 X |
| 4,645,559 | 2/1987 | Kaiser et al. | 156/583.1 |
| 4,692,135 | 9/1987 | Johnson | 156/583.1 X |
| 4,744,845 | 5/1988 | Posey | 156/583.1 X |
| 4,750,393 | 6/1988 | Yamagata | 83/618 X |

FOREIGN PATENT DOCUMENTS

| | | |
|---|---|---|
| 0246488 | 5/1987 | European Pat. Off. . |
| 912146 | 5/1954 | Fed. Rep. of Germany . |
| 2019855 | 11/1971 | Fed. Rep. of Germany . |
| 2532428 | 7/1975 | Fed. Rep. of Germany . |
| 2523203 | 12/1976 | Fed. Rep. of Germany . |
| 2010552 | 6/1968 | France . |

OTHER PUBLICATIONS

European Search Report.

Kuper, GmbH & Co. KG, Maschinenfab'k, p. 489.

*Primary Examiner*—David A. Simmons

*Assistant Examiner*—J. Sells

*Attorney, Agent, or Firm*—Scully, Scott, Murphy & Presser

[57] ABSTRACT

The invention relates to a device for cutting, according to a saw tooth pattern, the extremities of veneer tapes between two pairs of upper and under knives and for gluing those extremities under pressure by using i.a. a pression beam on which the necessary pressure is applied by a hammer of an oscillable press and which, for that purpose, is beared in a vertically displacable bridge, characterized in that the device comprises the following elements:

(a) means for locking the hammer (13) of said press with respect to said bridge (2):

(b) under and upper knives which cut the veneer tapes at different heights;

(c) means for bringing said hammer (13) in its rest position when it is delocked with respect to said bridge (2);

(d) a pneumatic cylinder (28) for pulling down said bridge (2);

(e) means for neutralizing the pression exerted by springs on the under knives.

8 Claims, 5 Drawing Sheets

DEVICE FOR CUTTING ACCORDING TO A SAW TOOTH PATTERN THE EXTREMITIES OF VENEER TAPES BETWEEN TWO PAIRS OF UPPER AND UNDER KNIVES

This application is a continuation of application Ser. No. 425,753 filed Oct. 23, 1989, now abandoned.

BACKGROUND OF THE INVENTION

The invention relates to a device for cutting, in a saw tooth pattern, the extremities of veneer tapes between two pairs of upper and under knives and for gluing those extremities under pressure. A sledge is used to pull an adhesive tape transversely with respect to the extremities of the veneer tapes, which are disposed above a pressure beam. The necessary pressure for gluing the veneer tapes is applied by a hammer connected to an oscillable press beared in a vertically displaceable bridge which is movable with respect to a fixed ground plate.

It is known to cut according to a saw tooth pattern and in a same sequence of actions, the extremities of veneer tapes by means of a press hammer which is pneumatically controlled, to bring the extremities together and glue them to each other by applying pressure and heat to the extremities. Adhesive tapes are moved transversely with respect to the displacement direction of the veneer tapes. However, devices directed to this end have suffered from drawbacks. High pressures are needed to perform the cutting and pressing functions, and consequently time efficiency is compromised in building sufficient pressure for the units to operate.

SUMMARY OF THE INVENTION

It is an object of the invention to present a device as mentioned hereabove which allows a lower pressure build up for pneumatically realizing the different operations described hereabove, allowing not only to save energy but above all time.

In order to realize this according to the invention, a device according to the invention comprises the following elements:

(a) means for locking a hammer of a press with respect to a bridge in such a manner that by a downward movement of the bridge the hammer comes into contact with the extremities of the veneer tapes resting on the pressure beam over which extremities an adhesive tape is disposed;

(b) under and upper knives which cut the veneer tapes at different heights, whereby the upper knives are adjusted at such heights that they do not come into contact with the under knives when said hammer pushes on the veneer tapes to be glued;

(c) means for bringing said hammer to a resting position when it is unlocked with respect to said bridge;

(d) a pneumatic cylinder or a technical equivalent cylinder for pulling down said bridge;

(e) means for neutralizing the pressure exerted by springs on the under knives.

In a remarkable embodiment of the invention, the bridge and the hammer and upper knives connected therewith are moved up and down with respect to a fixed ground plate by the action of two pairs of two arms which are kinematically connected to each other and wherein one of the arms is driven by a pneumatic cylinder. The pneumatic cylinder acts upon an eccentric by means of a level arm, which eccentric controls the oscillation of two of said arms. There is provided a kinematic connection between the arms.

Other details and advantages of the invention will become clear from the description given hereunder of a device for cutting, in a saw tooth pattern, the extremities of veneer tapes between two pairs of upper and under knives and for gluing those extremities according to the invention. The description is only given by way of example and does not limit the scope of the invention. The reference numbers relate to the annexed figures.

DETAILED DESCRIPTION OF THE PREFERRED EMBODIMENTS

Figure 1:
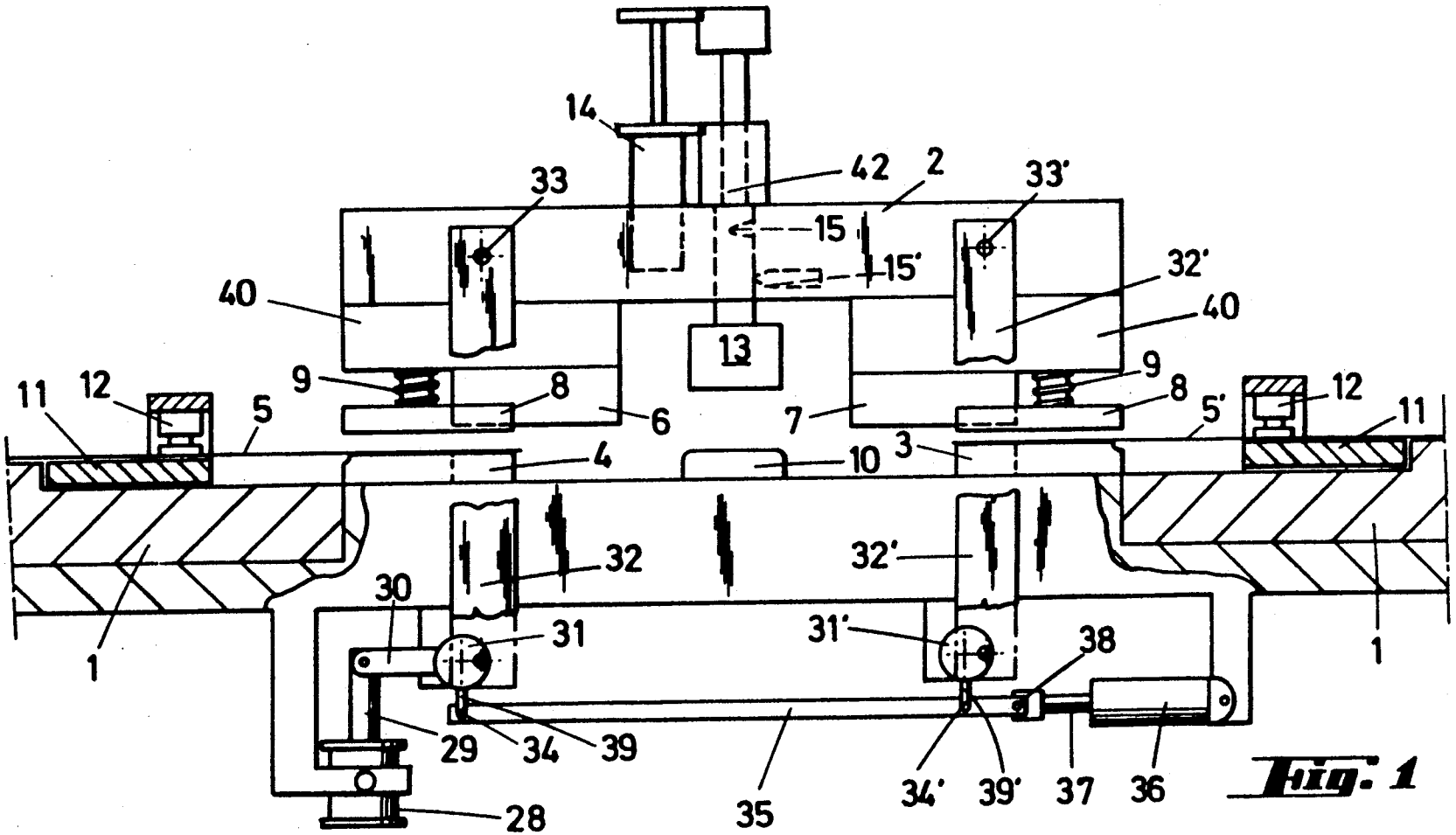
FIG. 1 is a schematic representation of a device in its resting position with an unlocked press hammer and the upper and under knives separated from each other.

The above figures only show the main elements of the device. The elements represented by the figures consist of a fixed ground plate which is attached to a frame of the device not represented and a bridge 2 which oscillates with respect to the ground plate 1. The conducts of the oscillating bridge are not represented in the figures.

A pair of under knives 3 and 4 are mounted on the fixed ground plate 1. The upper surface of the under knives 3 and 4, over which the veneer tapes 5 and 5' are guided and by which they are cut according to the desired saw tooth pattern, are on the same level as the ground plate 1.

Upper knives 6 and 7 cooperate with the under knives 3 and 4. A very important characteristic of the invention is embodied in the height difference of the cutting planes of the upper knives 6 and 7. During the cutting operation the extremities of the veneer tape 5 and 5' are kept against the under knives 3 and 4 by means of pressure members 8. That pressure is applied by means of springs 9.

The pressure exerted by those springs is neutralized by an air cylinder which will be described hereunder.

The two cutting operations, executed by the upper knives 6 and 7, are separated in time by a few fractions of a second; thus the necessary pneumatic pressure for cutting two thicknesses of veneer tapes is divided by two relative to the prior art pressure. This is a very important characteristic of the invention.

The veneer tapes 5 and 5' are brought towards pressure beam 10, thus towards each other, by means of slides 11. The oscillations of the slides over the ground plate 1 are controlled by known means; pneumatic cylinders 12 clamp the veneer tapes 5 and 5' respectively during their movement toward and away from each other, even during the cutting and gluing operations.

A hammer 13 of the pneumatic press exerts the necessary pressure on the pressure beam 10, in order to connect the adhesive tape by means of pressure and heat to the saw tooth shaped extremities of the veneer tapes. This operation can only take place when the press 14 is locked with respect to bridge 2.

Figure 2:
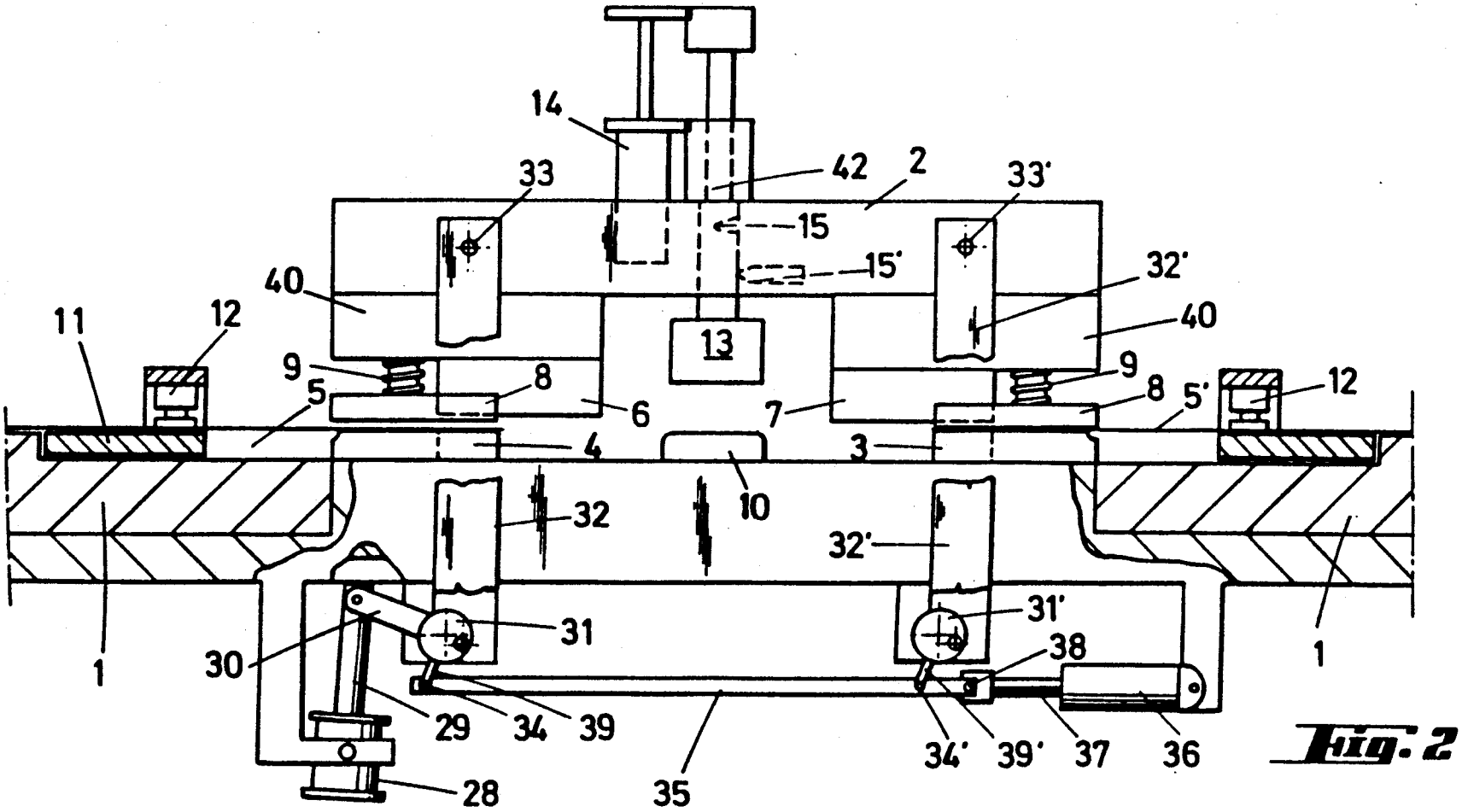
FIG. 2 is a schematic representation of a device according to the invention in a position wherein the press hammer is still not locked with respect to the bridge of the device and where the lowest upper knife cuts the veneer tape between itself and the corresponding under knife. The same will take place immediately thereafter between the uppermost upper knife and the corresponding under knife.
Figure 3:
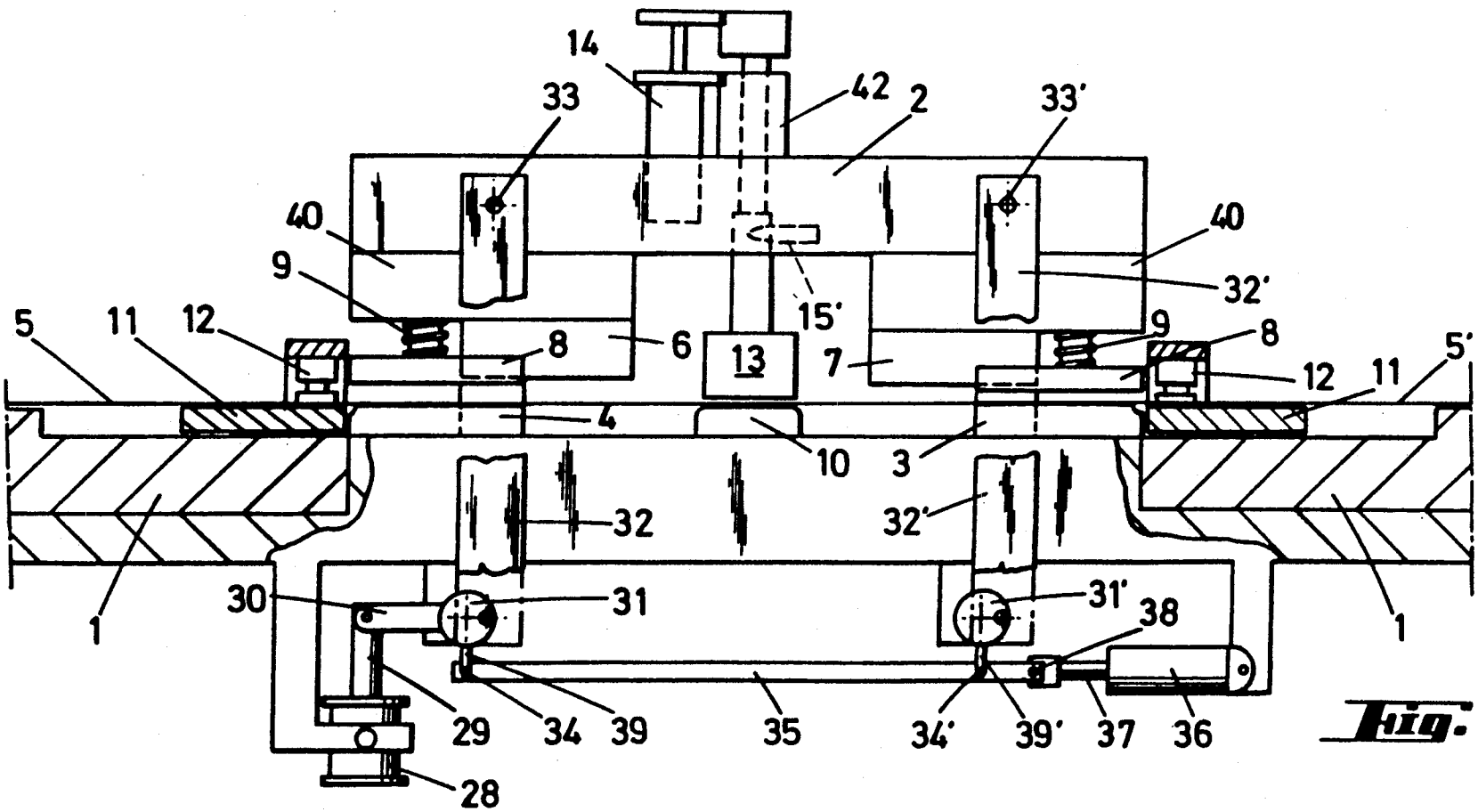
FIG. 3 is a schematic representation of a device whereby the press hammer is locked with respect to the bridge of the device while the respective upper and under knives are separated from each other.
Figure 4:
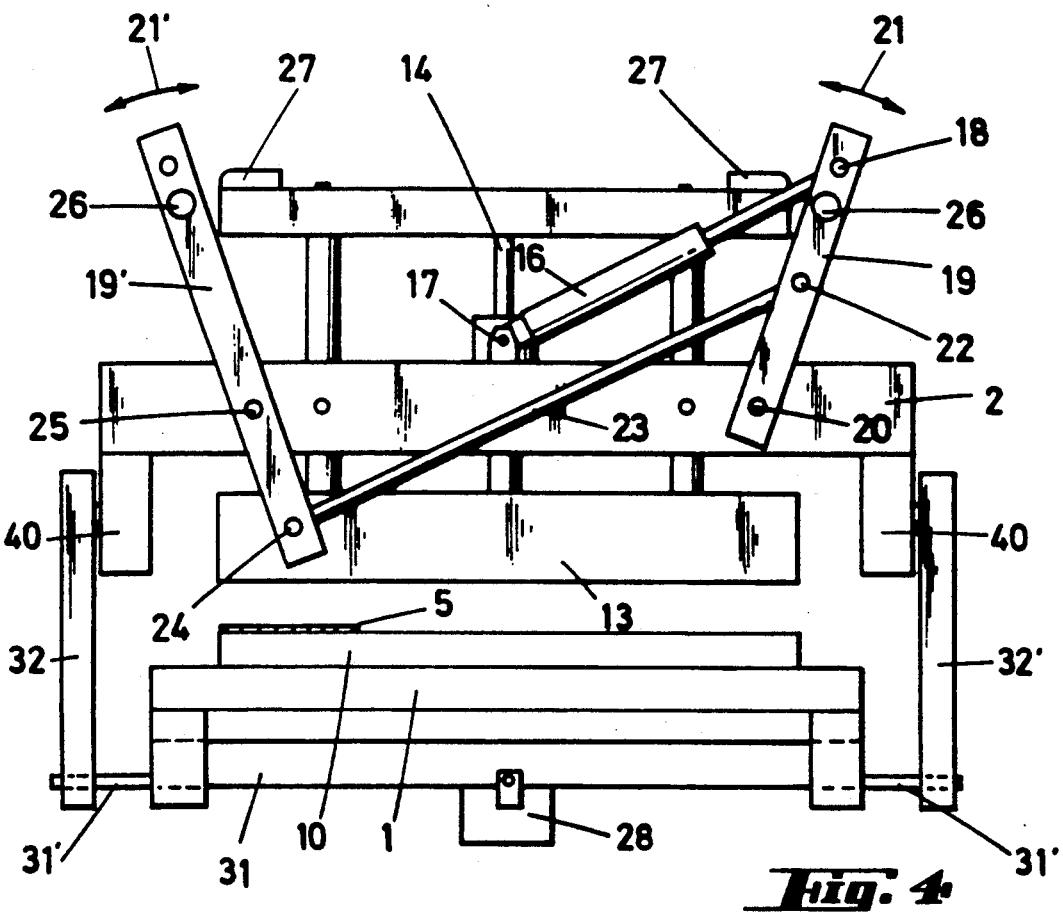
FIG. 4 is a schematic frontal view of a possible locking mechanism for the press hammer in the position wherein the latter is not locked with respect to the bridge.
Figure 5:
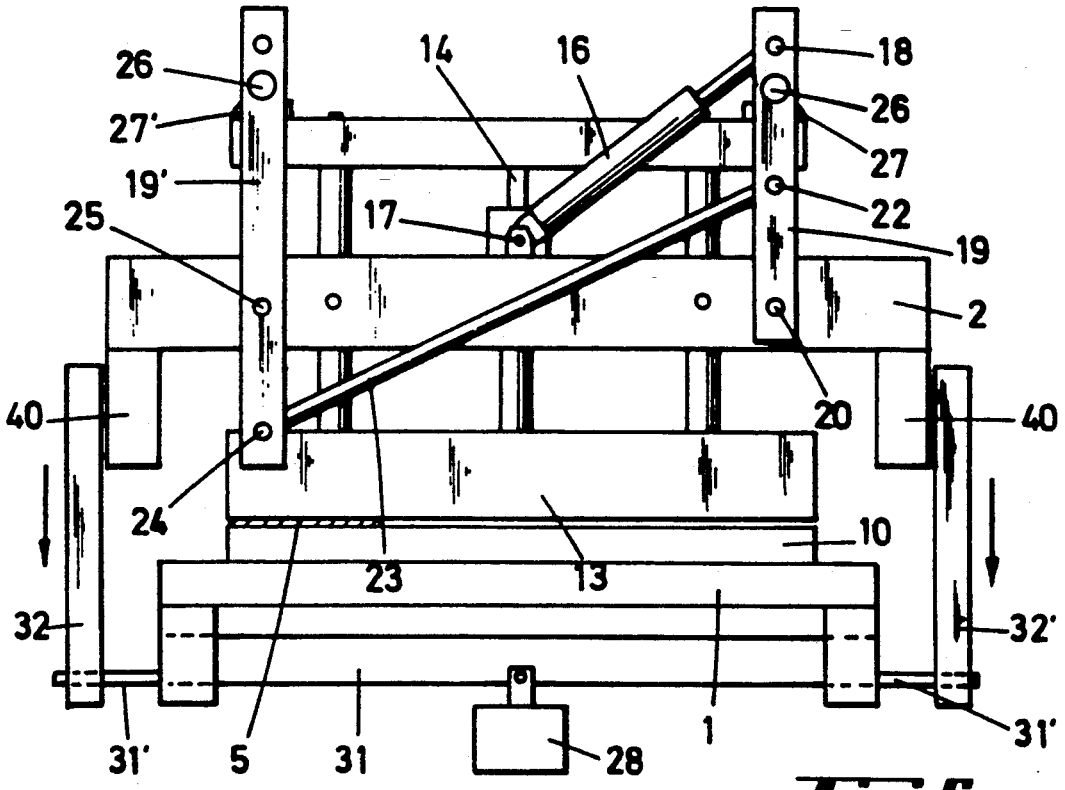
FIG. 5 is a comparable frontal view in the position wherein the press hammer is locked with respect to the bridge.

In the FIGS. 1, 2 and 3, the locking members are only schematically represented by means of a notch 15 and a wedge 15'. Another possible embodiment is represented by FIGS. 4 and 5 wherein a pneumatically controlled cylinder 16 controls the oscillating movement of the locking arm 19. Cylinder 16 has a hinge point 17 with respect to the bridge 2 and a hinge axis 18 on a pivoting locking arm 19. Locking arm 19 has a hinge point 20 on the same bridge 2. Locking arm 19 is hinge connected at 22 with a rod 23 which is hinge connected at 24 with a second locking arm 19' connected at a hinged point 25 to bridge 2.

The oscillating movement of the locking members 19' are represented by the arrows 21'.

The locking arms 19, 19' are constructed in such a manner that they can move on the front and back side of the hammer 13 and a pneumatic press 14. They thus form each time a pair of locking arms 19, 19' between which the axes 26, 26' are beared. Their purpose is to be pulled over the steel blocks 27 and 27' which are rounded off on the outer side, when the locking arms 19 and 19' are moved towards each other. That position is represented in FIG. 5. The locked position according to FIG. 5 corresponds of course also with the schematically represented locked position in FIG. 3.

The pressure required to pull down the bridge 2 with the upper knives 6 and 7 connected thereto and the pneumatic press 14 with the hammer 13, in such a manner that a cutting of the veneer tapes and the consequential gluing of the saw tooth shaped extremities can take place, is developed by a group of members and mechanical means which form another important characteristic of the invention.

The pressure is exerted by a sole pneumatic cylinder 28. That cylinder facilitates the cutting and pressing operations. The piston rod 29 thereof pushes lever 30 upwardly, which is in hinged connection therewith. Lever 30 is connected to an eccentric 31 which assures, during the movement of the piston rod and the lever 30, the downwardly displacement of the rods 32 and 32' which are hinged connected at points 33 and 33' with the bridge 2. The cylinder 28 only has to be displaced over a very short distance during the pressuring action which signifies a sensible saving when the necessary time and energy for realizing that pressure built-up is taken into account.

Starting from eccentric 31, the lateral oscillating movement of the connection rod 35 is assured by means of the lever 39 with the hinged point 34, which connection rod 35 acts upon a lever 39' by means of the hinged point 34' and an eccentric 31' on the oscillating movement of the arms 32', which are connected to the bridge 2 in a comparable way in 33'. That pneumatic cylinder 36 with piston rod 37 and hinged connection 38 with connection rod 35 furnishes the force for overcoming the pressure applied by the springs 9 while, during the return movement of the cylinder 28, the air from cylinder 36 is evacuated towards a not represented air conductor.

From the description which has just been given of a device according to the invention, it seems that:

1°) a sole cylinder, notably the pneumatic cylinder 28, assures the necessary pressure for cutting the extremities of the veneer tapes the compression and the gluing, by using heat of the saw tooth shaped extremities of the veneer tapes which are joined to each other and whereby that cylinder 28 is only displaced over a very limited distance during the pressing (approximately 1/5 with respect to comparable machines) and a greater force is developed thanks to the transmission system.

2°) that however another pneumatic cylinder assures the downwards displacement of the hammer 13;

3°) that the locking of the bridge 2 with respect to the ground plate 1 is realized in a very appropriate manner, also by making use of only one pneumatic cylinder and:

4°) the cutting of the saw tooth shaped extremities of the veneer tapes is realized in two steps. Energy used is in fact divided by two, because the thickness of the veneer tapes remains (*d*) and not (2*d*), which is also favorable to the pressure built-up of the pressing cylinder provided for that purpose.

5°) that the cylinder 36 (or technically equivalent cylinder) neutralizes the springs 9 during the cutting, while during the application of the pressure that force is transmitted to the hammer 13 and without using energy. During the movement back the cylinder 36 acts as a shock absorber.

From all this, it results that a substantial time saving and at the same time a substantial energy saving is obtained. This is especially valid when cutting thicker veneer tapes.

In order to obtain higher speeds during the cutting, the cylinder 28, together with the piston rod 29 and the lever 30 can be abandoned. The bridge 2 can then directly be pulled down by means of the rods 32 and 32'. This can, for example, be realized hydraulically, which enables the cutting of the thicker veneer tapes.

It will be clear that the invention is not limited to the above given embodiments and that many modifications can be applied hereto without deviating from the scope of the invention.

What is claimed is:

1. A device for cutting, according to a saw tooth pattern, the extremities of veneer tapes between two pairs of upper and under knives and for gluing those extremities under pressure by using a sledge which pulls an adhesive tape transversely with respect to the extremities of the veneer tapes, a pressure beam over which the extremities of the veneer tapes and the adhesive layers are disposed and on which the necessary pressure is applied by a hammer of an oscillable press and which, for that purpose, is beared in a vertically displaceable bridge, which is movable with respect to a fixed ground plate by the action of two pairs of arms which are kinematically connected to each other, one of the said arms being driven by a pneumatic cylinder, characterized in that the device comprises the following elements:

(a) a means for locking the hammer of said press with respect to said bridge in such a manner that by a downward movement of the bridge the hammer comes into contact with the extremities of the veneer tapes and the adhesive tape resting on the pressure beam;

(b) under and upper knives, the upper knives being attached to the vertically displaceable bridge wherein one of the upper knives extends below the bridge to a greater extent than the other upper knife such that the upper knives cut the veneer tapes at slightly different times, and wherein the upper knives are adjusted at different heights so that they do not come into contact with the under knives when said hammer pushes on the veneer tapes to be glued;

(c) means for bringing said hammer to its resting position when it is unlocked with respect to said bridge;

(d) a hydraulic cylinder for pulling down said bridge;

(e) means for overcoming the pressure exerted by springs on the under knives.

2. A device as claimed in claim 1, characterized in that said means for bringing said hammer to its working position is formed by a hydraulic cylinder which belongs to the pneumatic circuit to which belongs the hydraulic cylinder which brings said bridge down.

3. A device as claimed in claim 1, characterized in that said pneumatic cylinder acts upon an eccentric by means of a lever arm, which eccentric controls the oscillation of two of said arms by directly actuating one arm and kinematically actuating a connected arm.

4. A device as claimed in claim 3, characterized in that said kinematic connection is formed by a connection rod which transmits the action of eccentric to eccentric and thus synchronizes the action of the two arms (32) with the two arms (32').

5. A device as claimed in claim 1 characterized in that the means which secures said press with respect to said bridge are formed by locking arms which are mounted on the bridge via hinges, which locking arms are connected to each other by means of a rod, and wherein one locking arm, is moved by means of a pneumatic cylinder, in such a manner that those arms, lock the press with respect to the bridge during the pressing phase.

6. A device as claimed in claim 1 characterized in that said veneer tapes are kept on the under knives by means of pressing members which are moved down together with the bridge and are pressed against said under knives by means of springs, and means are provided for neutralizing the pressure of said springs during the cutting operation executed by said upper knives.

7. A device as claimed in claim 6, characterized in that a connection rod is connected with a pneumatic cylinder which neutralizes the pressure of springs and where said bridge returns to its start position and operates as a shock absorber by returning the air from the cylinder into the pneumatic circuit of the device.

8. A device for cutting veneer tapes in a saw tooth pattern according to claim 1 wherein the upper knives move in a vertical pattern.

* * * * *